United States Patent [19]

Pavlik et al.

[11] Patent Number: 4,963,199

[45] Date of Patent: Oct. 16, 1990

[54] DRILLING OF STEEL SHEET

[75] Inventors: Norman M. Pavlik, Wilkinsburg; John Sefko, Monroeville; Richard A. Miller, N. Huntingdon, all of Pa.

[73] Assignee: ABB Power T&D Company, Inc., Blue Bell, Pa.

[21] Appl. No.: 257,915

[22] Filed: Oct. 14, 1988

[51] Int. Cl.[5] ..... H01F 1/12

[52] U.S. Cl. ..... 148/307; 148/308; 428/596; 428/611; 428/638; 428/928

[58] Field of Search ..... 148/307, 308; 428/596, 428/611, 638, 428

[56] References Cited

U.S. PATENT DOCUMENTS

| | | | |
|---|---|---|---|
| 3,647,575 | 3/1972 | Fledler et al. | 148/111 |
| 4,293,350 | 10/1981 | Ichiyama et al. | 148/111 |
| 4,363,677 | 2/1982 | Ichiyama et al. | 148/111 |
| 4,456,812 | 6/1984 | Neiheisel et al. | 148/121 LM |
| 4,500,771 | 2/1985 | Miller | 219/121 LH |
| 4,535,218 | 8/1985 | Krause et al. | 219/121 LH |
| 4,613,842 | 9/1986 | Ichiyama et al. | 336/218 |
| 4,645,547 | 2/1987 | Krause et al. | 148/111 |

*Primary Examiner*—John P. Sheehan

*Attorney, Agent, or Firm*—Ostrolenk, Faber, Gerb & Soffen

[57] ABSTRACT

A steel sheet (10) having a stress-relief annealed, structure with a plurality of magnetic domains (12) is made by drilling a plurality of closely spaced, small holes (15) through the entire thickness of the steel sheet, where the drilling is effective to form additional domain walls (17) and subdivide the magnetic domains.

8 Claims, 1 Drawing Sheet

DRILLING OF STEEL SHEET

BACKGROUND OF THE INVENTION

This invention relates to drilling completely through oriented electromagnetic steel sheet in order to improve the watt-loss properties.

Core material of transformers and other electrical machinery has long been made from grain-oriented electromagnetic steel sheets. In these sheets, the metal grains are singly-oriented in the (110)[001] Goss-position, as expressed on the Miller index, where body center cubes are in the cube-on-edge position. These steel sheets are cold rolled, and annealed to recrystallize the grains and are usually made of "silicon-steel", i.e., contain from 1% to 4.5% silicon. A thin insulating film is usually applied to the surface of the sheets. These sheets have a direction of ease-of-magnitization in the direction of rolling.

The metal grains of these cold rolled, annealed steel sheets have ferromagnetic domains of large size, usually 5 mm to 25 mm across. The large magnetic domains result in watt-loss due mostly to "anomalous" eddy current loss, which can account for about ½ of the watt-loss at commercial frequencies, the rest being accountable to classical eddy current and hysteresis loss. A variety of methods have been used to decrease the width of magnetic domains within the metal crystal structure. Fiedler et al., in U.S. patent specification No. 3,647,575, teaches shallow grooving through the insulating film and metal sheet surface, transverse to the rolled direction after recrystallization annealing. Ichiyama et al., in U.S. patent specification No. 4,293,350, teaches brief laser pulse irradiation of the insulating film coated, finally annealed metal sheet surface, transverse to the rolled direction, to induce a small but significant substructure, in order to limit domain widths and improve core loss. Both of these processes damage the mill glass or other insulative coating on the sheet surface.

Neiheisel et al., in U.S. patent specification No. 4,456,812, teaches continuous laser beam scanning across the rolled direction of the insulating film coated, metal sheet surface, to subdivide magnetic domains without damaging the insulative coating. Krause et al., in U.S. patent specification No. 4,645,547, teach a somewhat similar process, and Miller, in U.S. patent specification No. 4,500,771, and Krause et al., in U.S. patent specification No. 4,535,218 first curve the width of the sheet.

Ichiyama et al., in U.S. patent specification No. 4,363,677, teaches laser-beam irradiation of finally annealed metal sheet, followed by formation of an insulating film on the sheet surface at temperatures of less than 600° C., so that subdivision of the magnetic domains is not reversed. The laser beam irradiation regions can be in the form of continuous lines, broken lines, or spots. The spots, which do not penetrate deeply into the metal surface, have an area of not less than $10^{-5}$ mm$^2$, with a diameter between 0.004 mm (0.15 mil) and 1 mm (39 mil). Similarly, Ichiyama et al., in U.S. patent specification No. 4,613,842, teaches the same size, laser formed continuous lines, broken lines, or spots, utilized on different components of transformer cores, where the pattern of the lines or spots may differ, depending on the placement of the component.

In both Ichiyama et al. patent specifications, the laser beam irradiation transverse to the direction of ease-of-magnetization causes generation of small projections, which form nuclei of magnetic domains having walls at a 90° angle to the laser pattern across the width of the component. This laser treatment causes the domains of the grain-oriented electromagnetic steel sheet to be subdivided. As a result of the subdivision the watt-loss properties are reduced. In both of these Ichiyama et al. methods, the sheets tend to bow after laser treatment, sometimes requiring an additional heat flattening step.

All of these prior art methods reduce watt-loss at varying levels up to 15%. However, all appear to lose the advantage of the laser scribing and resultant domain refinement when subjected to a subsequent stress relief anneal at over 700° C. Therefore, these processes can be utilized only for stacked transformer core applications. What is needed is a method to produce the same watt-loss reduction, but which survives a 700° C. to 800° C. stress relief anneal. It is one of the main objects of this invention to provide treated, electromagnetic steel sheet which will reduce watt-loss up to 14%, which will impart equal stress through the volume of the sheet with no sheet distortion or bowing, will not reduce space factor or insulative coating resistance, and which will survive a 700° C. stress relief anneal.

SUMMARY OF THE INVENTION

Accordingly, the invention resides in a method of treating flat, electromagnetic steel sheet, by cold rolling steel into a sheet and subjecting the sheet to annealing, to produce a structure having a plurality of magnetic domains, characterized in that the treatment consists of drilling, preferably by laser, a plurality of closely spaced holes, preferably having diameters of from 0.02 mm (0.78 mil) to 0.20 mm (7.8 mil) through the entire thickness of the sheet, so as to form additional domain walls and subdivide the magnetic domains in an amount effective to lower watt-loss properties while retaining the flatness of the sheet. These sheets can be drilled after protective coating film application on at least one surface of the sheet, with minimal damage to the coating. The drilling process does not affect the sheet flatness at all, so that the finished sheet does not need to be recoated and thermally flattened. Very importantly, this drilled steel sheet can be relief annealed at over 700° C. without substantially affecting domain subdivision.

Preferably, the sheet is a singly oriented cube-on-edge silicon-steel, the initial distance between domain walls is from approximately 5 mm to 25 mm, and the hole spacing, center to center, in each row transverse to the direction of ease-of-magnetization, is from 0.40 mm (15.6 mil) to 3.2 mm (124.8 mil) apart. The invention also resides in through-hole drilled, stress-relief annealed, cold rolled electromagnetic steel made by the process previously described, to provide a sheet where the through holes are effective to subdivide the magnetic domains.

As a result of the process of this invention, the drilled sheet refines the 180° domains by inducing free poles. Laser drilling is much preferred because even the most modern mechanical microdrilling technology cannot, at the present time, provide drilled holes in metal smaller than about 0.13 mm (5 mil) diameter. The preferred diameter of the laser drilled holes according to the invention is from 0.04 mm (1.5 mil) to 0.08 mm (3.1 mil). Laser drilling also provides a fast method capable of commercial line speeds.

BRIEF DESCRIPTION OF THE DRAWINGS

In order that the invention will become more readily apparent, the following description of preferred embodiments will now be described, by way of example only, with reference to the accompanying drawings, in which.

DESCRIPTION OF THE PREFERRED EMBODIMENTS

Figure 1:
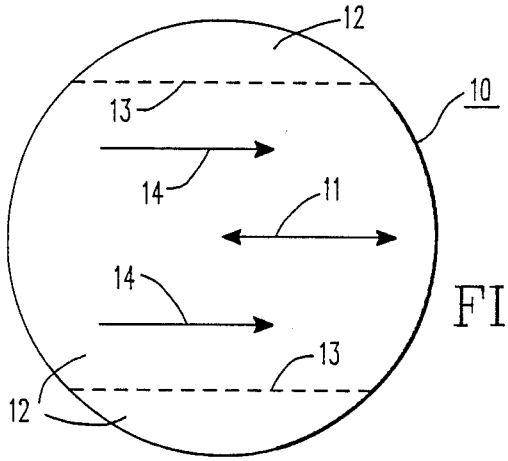
FIG. 1 shows a greatly enlarged area of the top of a flat, cold rolled, annealed, electromagnetic steel sheet, with underlying, idealized, large, magnetic domains, the walls of which are shown as dashed lines.

Referring to FIG. 1, a greatly enlarged area of a flat, cold rolled, insulation coated, high temperature annealed, electromagnetic steel sheet 10 is shown, with the direction of rolling shown by arrow 11. The cold rolling and annealing provide large magnetic domains 12, shown separated by 180° Bloch walls 13, usually from approximately 5 mm to 25 mm apart. These domains will ordinarily be in singly, cube-on-edge oriented metal crystals, designated (110)[001] in accordance with Miller's indices, with the direction of ease-of-magnetization parallel to the direction of rolling 11, and having magnetic lines of force 14 parallel to the direction of rolling.

A typical melt to provide such singly-oriented steel could contain, for example: C less than 0.085%; Si 1% to 4.5%; S 0.015% to 0.07%; and Mn 0.02% to 0.2%, with the rest being Fe, to provide a silicon-steel melt. The melt can be cast in slab form, hot rolled at approximately 1400° C. to a desired thickness, annealed at approximately 1000° C., subjected to an acid treatment to remove scale and oxide, cold rolled to final gauge, heated in a reducing atmosphere to remove carbon, coated on one or both sides with one or more layers of magnesia or the like to provide an insulating protective surface film, and then high temperature final annealed at up to 1200° C., to provide final grain-orientation and magnetic characteristics, as is well known in the art. In some instances an additional insulative coating is applied to the sheet surface after the high temperature anneal, followed by short thermal heating at approximately 850° C. to flatten and stress relieve the sheet, and to cure the coating.

While this is the usual type of steel sheet used for core material of transformers and other electrical machinery, the method of this invention can be used for any magnetic steel sheet having magnetic domains, with wall spacings over approximately 5 mm, the subdivision of which would reduce anomalous eddy current loss and thus produce core watt-loss improvement.

Figure 2A:
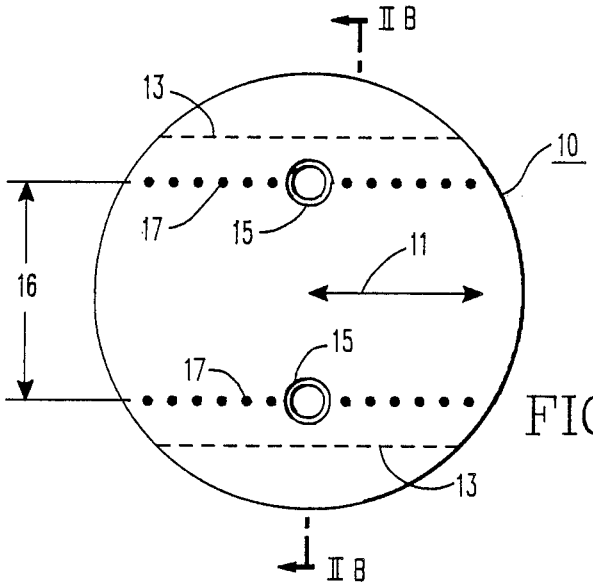
FIGS. 2A and 2B, which best illustrate this invention, show, in FIG. 2A, a greatly enlarged area of the top of a flat, cold rolled, annealed, electromagnetic steel sheet, having holes drilled completely through the volume of the sheet with a laser beam, with underlying, idealized, magnetic domains having drilling induced nuclei which propagate additional domain walls, shown as dotted lines, resulting in subdivided domains and reduction of watt-loss properties in use; and, in FIG. 2B, a cross-section of the sheet of FIG. 2A, showing a tapered, laser drilled hole completely through the metal sheet and top and bottom insulative coating.
Figure 2B:
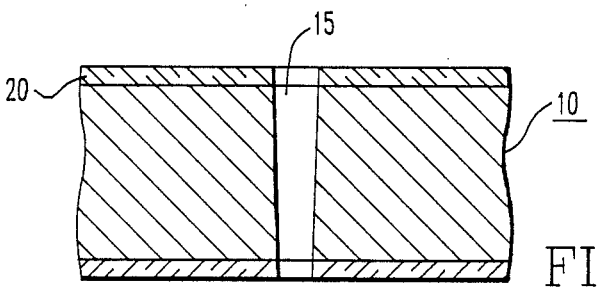

In this invention, the cold rolled, insulation coated, high temperature annealed, steel sheet of FIG. 1, is drilled to provide closely spaced holes or vias 15, through the entire thickness of the coated sheet 10, as shown in FIGS. 2A and 2B. It is essential that the holes be all the way through the sheet or the sheet can bow, requiring an extra hot flattening step. The holes will preferably have diameters of from 0.02 mm (0.78 mil) to 0.20 mm (7.8 mil), preferably from 0.04 mm (1.5 mil) to 0.08 mm (3.1 mil), and will be drilled in rows B-B, transverse (90°±3°) to the direction of rolling 11 and magnetic lines of force 14, to produce the drilled sheet shown.

The laser drilled holes will have a spacing, center to center, shown as 16, in each row of from 0.40 mm (15.6 mil) to 3.2 mm (124.8 mil). Spacing between additional, adjacent rows (not shown) is from 5 mm (195 mil) to 7 mm (273 mil). Holes less than 0.02 mm diameter will not be completely effective in subdividing domains and are difficult to drill. Holes over 0.2 mm diameter and hole spacing less than 0.4 mm in a row will reduce the steel cross sectional area, resulting in higher flux density and higher core loss and exciting power. Spacing over 3.2 mm in each row and over 7 mm in adjacent rows will yield insufficient reduction in domain spacing, for optimum reduction in core loss. Hole spacing less than 5 mm between adjacent rows will provide a reduction in domain spacing.

The laser used would be either a pulsed YAG (yttrium aluminum garnet) or pulsed $CO_2$ laser, producing monochromatic electromagnetic radiation capable of vaporizing metal. These lasers would provide a laser beam having a wavelength, preferably of from about 1 micron to about 2 microns, usually 1.06 microns, and are capable, in pulsed mode, of drilling a clean hole, with good definition and smooth sides with minor harm to the workpiece surface. Use of this wavelength will allow the laser beam to pass through the mill glass or other applied insulative coating on the sheet with only minimal adsorption.

When the short wavelength laser is used, it should be operated in a pulsed mode, to control the drilling, and prevent damage to the metal and the insulating coating. In order to allow sufficient dwell time to allow the laser energy to cleanly drill through the metal, preferably pulse widths of from 75μ sec to 300μ sec may be utilized. Since the holes will pass through the metal sheet, physical distortion or bowing of the sheet will be minimal. By drilling a plurality of spaced holes rather than irradiating an entire line transverse to the direction of rolling, much less degradation of the total top insulating coating can be expected. A suitable registering means would be used to assure proper spacing between holes in each row and spacing between rows. Since small portions of the insulation are deliberately vaporized anyway, sufficient laser energy can be used to insure effective domain split-up.

Upon drilling the holes through the metal sheet and the underlying magnetic domain, nuclei form closure domains around the holes. These nuclei instantaneously cause subdivision of the large domains of individual crystallites through the volume of the steel. In FIG. 2A, newly formed Bloch walls parallel to the direction of rolling are shown as dotted lines 17.

The volume subdivision of the large domains will be effective to provide a plurality of smaller domains, from about 1 to 20 additional domains, all preferably less than 5 mm in width, in an amount effective to improve the watt-loss of the drilled sheet as compared to the watt-loss the sheet had before drilling. This causes a decrease in the width of 180° magnetic domains. Where a large domain having walls 13 is shown in FIG. 1, that domain has been split into 3 domains having walls 17 in FIG. 2A after drilling through the entire sheet. Very importantly, even after a subsequent stress relief annealing step at temperatures over 700° C., usually at 750° C. to 800° C., the subdivision of the magnetic domains, as well as the flatness of the sheet is not affected.

FIG. 2B shows a crosssection of the drilled metal sheet 10, showing hole 15 all the way through the body of the metal sheet 10, and top and bottom, protective, insulation coating film 20. As can be seen, generally when a laser is used, the drilled hole will be tapered, having a somewhat smaller bottom diameter than top diameter. If proper laser pulse parameters are used along with proper registration techniques, a clean hole should be made through the insulation coating film 20. Useful insulation coatings, in one or a plurality of layers, on one or both sides of the sheet, include magnesia, aluminum-magnesiumphosphate, mill glass, and the like, well known in the art. The sheet 10 thickness can range from 0.05 mm (2 mil) to 0.38 mm (15 mil) and the total insulation coating film thickness can range from 0.005 mm (0.2 mil) to 0.025 mm (1 mil). The invention will now be illustrated with reference to the following Example.

EXAMPLE

Cold rolled, annealed, silicon-steel specimens 15.2 cm×22.8 cm×0.02 cm thick (6 in.×9 in.×0.009 in.), containing approximately 3% Si and having a 0.012 mm (0.5 mil) thick protective, insulating coating film of mill glass, were laser treated by laser drilling a plurality of holes completely through the sheets. The laser used was a Raytheon, 400 watt, Pulsed Neodymium-YAG laser. Drilling was accomplished at pulse widths of 125μ sec to 280μ sec, with 15 to 200 pulses/second at a 5.08 cm (2 inch) focal length. The laser drilled specimens were then submitted to an 800° C. stress relief annealing operation in 90% nitrogen-10% hydrogen gas for about 60 minutes. The stress relieved specimens were then tested for core-loss compared to an untreated specimen having no laser drilled holes. The results are provided below in Table 1:

TABLE 1

| Sample Control | Laser Hole Spacing Not Drilled | Laser Hole Diameter Not Drilled | Core Loss $P_c$/kg 15 KG 0.902 | 17 KG 1.214 | 18 KG 1.524 |
|---|---|---|---|---|---|
| 1 | 3.2 mm (125 mil) | 0.13 mm (5 mil) | 0.884 | 1.163 | 1.443 |
| | Loss Reduction % | | −2.0% | −4.2% | −5.3% |
| 2 | 1.58 mm (62 mil) | 0.13 mm (5 mil) | 0.833 | 1.115 | 1.348 |
| | Loss Reduction % | | −7.6% | −8.1% | −11.5% |
| 3 | 0.80 mm (31 mil) | 0.05 mm (2 mil) | 0.809 | 1.085 | 1.315 |
| | Loss Reduction % | | −10.2% | −10.6% | −13.7% |
| 4 | 0.40 mm (15 mil) | 0.05 mm (2 mil) | 0.805 | 1.102 | 1.335 |
| | Loss Reduction % | | −10.7% | −9.2% | −12.4% |

The laser holes produced had a top diameter larger than the bottom diameter, producing a tapered hole. There was no detectable distortion of strip Samples 1 through 4, nor any visable insulating coating damage. Franklin interlamination resistance on the bottom side of the sheet, averaged 290 ohm-cm$^2$/lam before and after laser drilling. As can be seen from Table 1, permanent magnetic domain refinement was confirmed after an 800° C. stress relieve anneal, with best results using 0.05 mm diameter holes and close spacing within the laser drilled row.

We claim:

1. A silicon-steel sheet having a stress-relief annealed, oriented structure with a plurality of magnetic domains, the improvement wherein said steel sheet has a plurality of closely spaced, small holes through the entire thickness of the steel sheet, said holes being effective to propagate additional domain walls and subdivide the magnetic domains.

2. The sheet of claim 1, wherein said plurality of small holes are disposed in at least one line which is transverse to the direction of orientation of said sheet.

3. The sheet of claim 1, wherein that said plurality of small holes have diameters from 0.02 mm to 0.20 mm.

4. The sheet of claim 1, wherein said plurality of holes are formed by the process of laser-drilling.

5. The sheet of claim 1, wherein said sheet has thin insulative protective coating films on its opposite surfaces; said plurality of openings extending through said coating films.

6. The sheet of claim 3, said plurality of holes are formed by the process of laser-drilling.

7. The sheet of claim 3, wherein said sheet has thin insulative protective coating films on its opposite surfaces; said plurality of openings extending through said coating films.

8. The sheet of claim 4, wherein said sheet has thin insulative protective coating films on its opposite surfaces; said plurality of openings extending through said coating films.

* * * * *